US010058170B2

(12) United States Patent
Gosling et al.

(10) Patent No.: US 10,058,170 B2
(45) Date of Patent: Aug. 28, 2018

(54) MODULAR WALLS WITH EMBEDDED FURNITURE AND OPPOSING FEATURE

(71) Applicant: DIRTT Environmental Solutions, Ltd., Calgary (CA)

(72) Inventors: Geoff W. Gosling, Calgary (CA); Colin V. Blehm, Calgary (CA)

(73) Assignee: DIRTT Environmental Solutions, LTD, Calgary (CA)

( * ) Notice: Subject to any disclaimer, the term of this patent is extended or adjusted under 35 U.S.C. 154(b) by 0 days.

(21) Appl. No.: 15/177,084

(22) Filed: Jun. 8, 2016

(65) Prior Publication Data

US 2017/0226754 A1 Aug. 10, 2017

Related U.S. Application Data

(60) Provisional application No. 62/293,568, filed on Feb. 10, 2016, provisional application No. 62/263,573, filed on Feb. 10, 2016.

(51) Int. Cl.
*A47B 5/00* (2006.01)
*A47B 5/04* (2006.01)
(Continued)

(52) U.S. Cl.
CPC ..... *A47B 5/04* (2013.01); *A47B 5/006* (2013.01); *A47B 46/00* (2013.01); *A47C 4/04* (2013.01);
(Continued)

(58) Field of Classification Search
CPC ..... A47B 13/12; F21V 33/00; F21V 33/0012; F21V 33/0048
(Continued)

(56) References Cited

U.S. PATENT DOCUMENTS 2,042,290 A 5/1936 Barrett
2,658,810 A 11/1953 Ellis
(Continued)

FOREIGN PATENT DOCUMENTS

CA 55086 10/1985
CA 1294107 11/1987
(Continued)

OTHER PUBLICATIONS

Non-Final Office Action in U.S. Appl. No. 15/177,095 dated Jul. 24, 2017.
(Continued)

*Primary Examiner* — Matthew W Ing
(74) *Attorney, Agent, or Firm* — Workman Nydegger

(57) ABSTRACT

Embedded furniture systems include a furniture assembly having a furniture stowage component and a furniture element extending from and moveably connected to the stowage component. The stowage component has a body with a furniture compartment recessed therein. The furniture element is selectively stowable in the compartment and deployable therefrom on a first side of the assembly. The assembly extends through an opening disposed in a wall component. The surface of the first side of the assembly is aligned with a first side of the wall and the covered portion of the body extends from an opposing second side of the wall. A concealing element is disposed about and substantially covers an exposed portion of the body on an opposing second side of the assembly. The concealing element includes a substantially hollow furniture component such that the covered portion of the body appears to be a piece of furniture.

20 Claims, 13 Drawing Sheets

(51) Int. Cl.

| | |
|---|---|
| ***A47C 17/38*** | (2006.01) |
| ***A47C 17/86*** | (2006.01) |
| ***A47C 4/04*** | (2006.01) |
| ***F21V 33/00*** | (2006.01) |
| ***F21V 23/02*** | (2006.01) |
| ***F21V 23/04*** | (2006.01) |
| ***A47B 46/00*** | (2006.01) |
| ***E04F 19/08*** | (2006.01) |
| *F21W 131/301* | (2006.01) |

(52) U.S. Cl.
CPC ..... *A47C 17/38* (2013.01); *A47C 17/86* (2013.01); *E04F 19/08* (2013.01); *F21V 23/02* (2013.01); *F21V 23/04* (2013.01); *F21V 33/0012* (2013.01); *F21W 2131/301* (2013.01)

(58) Field of Classification Search
USPC ..... 108/23, 48, 79
See application file for complete search history.

(56) References Cited

U.S. PATENT DOCUMENTS

| | | | |
|---|---|---|---|
| 2,676,481 | A | 4/1954 | Hoffman |
| 3,037,593 | A | 6/1962 | Webster |
| 3,088,127 | A | 5/1963 | Charles |
| 3,180,457 | A | 4/1965 | Bohnsack |
| 3,521,937 | A | 7/1970 | Buhrmaster |
| 3,602,226 | A | 9/1971 | Ericson |
| 3,621,635 | A | 11/1971 | Lange |
| 3,675,382 | A | 7/1972 | Lickliter |
| 3,696,569 | A | 10/1972 | Didry |
| 3,885,361 | A | 5/1975 | De Schutter |
| 4,027,878 | A | 6/1977 | Dadbeh |
| 4,103,373 | A | 8/1978 | Luedtke |
| 4,128,983 | A | 12/1978 | Matsubara |
| 4,277,920 | A | 7/1981 | Dixon |
| 4,438,614 | A | 3/1984 | Raith |
| 4,449,337 | A | 5/1984 | Gzym |
| 4,493,172 | A | 1/1985 | Jones |
| 4,535,577 | A | 8/1985 | Tenser |
| 4,631,881 | A | 12/1986 | Charman |
| 4,688,491 | A | 8/1987 | Herrera |
| 4,752,101 | A | 6/1988 | Yurchenco |
| 4,757,657 | A | 7/1988 | Mitchell |
| D302,497 | S | 8/1989 | Zapf |
| D309,381 | S | 7/1990 | Buhk |
| D309,382 | S | 7/1990 | Randall |
| D309,384 | S | 7/1990 | Buhk |
| D309,385 | S | 7/1990 | Buhk |
| 4,991,365 | A | 2/1991 | Jackson |
| D309,386 | S | 7/1991 | Randall |
| 5,038,539 | A | 8/1991 | Kelley |
| 5,056,285 | A | 10/1991 | Frascaroli |
| D321,801 | S | 11/1991 | Friedman |
| 5,064,247 | A | 11/1991 | Clark |
| D323,251 | S | 1/1992 | Zapf |
| 5,086,597 | A | 2/1992 | Kelley |
| D325,309 | S | 4/1992 | Worrell |
| 5,117,599 | A | 6/1992 | Voss |
| D327,794 | S | 7/1992 | Zapf |
| D328,680 | S | 8/1992 | Zapf |
| 5,144,777 | A | 9/1992 | Fishel |
| D330,295 | S | 10/1992 | Zapf |
| 5,155,955 | A | 10/1992 | Ball |
| D330,641 | S | 11/1992 | Zapf |
| D330,643 | S | 11/1992 | Zapf |
| 5,159,793 | A | 11/1992 | Deugo |
| D331,335 | S | 12/1992 | Zapf |
| D331,513 | S | 12/1992 | Zapf |
| 5,171,060 | A | 12/1992 | Kaye |
| 5,172,530 | A | 12/1992 | Fishel |
| 5,184,441 | A | 2/1993 | Balfanz |
| 5,204,149 | A | 4/1993 | Phenicie |
| 5,207,037 | A | 5/1993 | Giles |
| 5,218,799 | A | 6/1993 | Appino |
| D337,003 | S | 7/1993 | Rowland |
| 5,227,005 | A | 1/1994 | Hellwig |
| 5,321,579 | A | 6/1994 | Brown |
| D348,786 | S | 7/1994 | Tolleson |
| 5,351,452 | A | 10/1994 | Gates |
| 5,352,033 | A | 10/1994 | Gresham |
| 5,394,668 | A | 3/1995 | Lim |
| 5,488,808 | A | 2/1996 | Cahill |
| D371,683 | S | 7/1996 | Tolleson |
| 5,544,593 | A | 8/1996 | Canfield |
| 5,592,794 | A | 1/1997 | Tundaun |
| 5,600,926 | A | 2/1997 | Ehrlich |
| 5,601,348 | A | 2/1997 | Minkovski |
| 5,642,593 | A | 7/1997 | Shieh |
| 5,669,314 | A | 9/1997 | Grant |
| 5,740,644 | A | 4/1998 | Menchetti |
| 5,740,650 | A | 4/1998 | Seiber |
| 5,740,744 | A | 4/1998 | Nashirozawa |
| 5,746,035 | A | 5/1998 | Seiber |
| 5,792,541 | A | 8/1998 | Herrera |
| D397,880 | S | 9/1998 | Saul |
| D398,464 | S | 9/1998 | Cronk |
| 5,802,789 | A | 9/1998 | Goodman |
| 5,813,178 | A | 9/1998 | Edwards |
| 5,822,935 | A | 10/1998 | Mitchell |
| 5,826,385 | A | 10/1998 | Dykstra |
| 5,836,121 | A | 11/1998 | Hofman |
| 5,839,240 | A | 11/1998 | Eisholz |
| 5,852,904 | A | 12/1998 | Yu |
| 5,870,867 | A | 2/1999 | Mitchell |
| 5,875,596 | A | 3/1999 | Muller |
| 5,881,979 | A | 3/1999 | Rozier |
| 5,913,787 | A | 6/1999 | Edwards |
| 5,950,386 | A | 9/1999 | Shipman |
| 5,978,988 | A | 11/1999 | Burchett |
| 6,012,258 | A | 1/2000 | Brown |
| 6,047,508 | A | 4/2000 | Goodman |
| 6,058,667 | A | 5/2000 | MacDonald |
| 6,094,872 | A | 8/2000 | Ward |
| 6,112,472 | A | 9/2000 | Van Dyk |
| 6,122,871 | A | 9/2000 | Russell |
| 6,128,877 | A | 10/2000 | Goodman |
| 6,134,845 | A | 10/2000 | Shipman |
| 6,141,926 | A | 11/2000 | Rossiter |
| 6,158,179 | A | 12/2000 | Ackerly |
| 6,161,347 | A | 12/2000 | Yu |
| 6,189,270 | B1 | 2/2001 | Jeffers |
| 6,223,485 | B1 | 5/2001 | Beck |
| 6,250,020 | B1 | 6/2001 | Shipman |
| 6,250,032 | B1 | 6/2001 | Davis |
| 6,260,321 | B1 | 7/2001 | Rudduck |
| 6,282,854 | B1 | 9/2001 | Vos |
| 6,295,764 | B1 | 10/2001 | Berrdige |
| 6,301,846 | B1 | 10/2001 | Waalkes |
| 6,311,441 | B1 | 11/2001 | Beavers |
| 6,330,773 | B1 | 12/2001 | MacDonald |
| 6,341,457 | B1 | 1/2002 | Aerts |
| 6,363,663 | B1 | 4/2002 | Kane |
| 6,393,782 | B1 | 5/2002 | Berrdige |
| 6,393,783 | B2 | 5/2002 | Emaus |
| 6,397,533 | B1 | 6/2002 | Hornberger |
| 6,415,567 | B1 | 7/2002 | Mead |
| 6,446,396 | B1 | 9/2002 | Marangoni |
| 6,481,168 | B1 | 11/2002 | Hodges |
| 6,484,465 | B2 | 11/2002 | Higgins |
| 6,490,154 | B2 | 12/2002 | Thompson |
| 6,497,075 | B1 | 12/2002 | Schreiner |
| 6,530,181 | B1 | 3/2003 | Seiber |
| 6,557,310 | B2 | 5/2003 | Marshall |
| 6,571,855 | B1 | 6/2003 | Goldsmith |
| 6,581,344 | B1 | 6/2003 | Niewiadomski |
| 6,591,563 | B2 | 7/2003 | King |
| 6,612,077 | B2 | 9/2003 | Parshad |
| 6,619,008 | B1 | 9/2003 | Shivak |
| 6,658,805 | B1 | 12/2003 | Yu |
| 6,668,514 | B2 | 12/2003 | Skov |
| D485,096 | S | 1/2004 | Overthun |
| 6,684,929 | B2 | 2/2004 | MacDonald |

(56) References Cited

U.S. PATENT DOCUMENTS

| | | | |
|---|---|---|---|
| 6,688,056 | B2 | 2/2004 | Von Hoyningen Huene |
| 6,701,677 | B2 | 3/2004 | Gresham |
| 6,711,871 | B2 | 3/2004 | Beirise |
| 6,729,085 | B2 | 5/2004 | Newhouse |
| 6,748,710 | B2 | 6/2004 | Gresham |
| 6,775,953 | B2 | 8/2004 | Burken |
| 6,799,404 | B2 | 10/2004 | Spransy |
| 6,807,776 | B2 | 10/2004 | Girdwood |
| 6,820,388 | B2 | 11/2004 | Newhouse |
| 6,851,226 | B2 | 2/2005 | MacGregor |
| 6,865,853 | B2 | 3/2005 | Burken |
| 6,883,277 | B2 | 4/2005 | Wiechecki |
| 6,889,477 | B1 | 5/2005 | Kottman |
| 6,920,727 | B2 | 7/2005 | Yu |
| 6,928,785 | B2 | 8/2005 | Shipman |
| 6,941,716 | B2 | 9/2005 | Kottman |
| 6,944,993 | B1 | 9/2005 | Jilk |
| 6,951,085 | B2 | 10/2005 | Hodges |
| 6,964,138 | B2 | 11/2005 | Carroll |
| 6,981,454 | B2 | 1/2006 | Burdick |
| 6,990,909 | B2 | 1/2006 | Gosling |
| 6,993,875 | B2 | 2/2006 | Rudduck |
| 7,051,482 | B2 | 5/2006 | MacDonald |
| 7,150,127 | B2 | 12/2006 | Underwood |
| 7,210,270 | B1 | 5/2007 | King |
| 7,310,918 | B1 | 12/2007 | Reuter |
| 7,434,790 | B1 | 10/2008 | Hansen |
| 7,451,577 | B2 | 11/2008 | Little |
| 7,461,484 | B2 | 12/2008 | Battey |
| 7,540,115 | B2 | 6/2009 | Metcalf |
| 7,562,504 | B2 | 7/2009 | Herbst |
| 7,603,821 | B2 | 10/2009 | Eberlein |
| 7,644,552 | B2 | 1/2010 | Kuipers |
| 7,661,237 | B2 | 2/2010 | Jakob-Bamberg |
| 7,707,790 | B2 | 5/2010 | Williams |
| 7,818,932 | B2 | 10/2010 | Eberlein |
| 7,827,745 | B2 | 11/2010 | Franceschet |
| 7,832,154 | B2 | 11/2010 | Gosling |
| 7,841,142 | B2 | 11/2010 | Towersey |
| 7,856,777 | B2 | 12/2010 | Lamfers |
| 7,861,474 | B2 | 1/2011 | Houle |
| 7,891,148 | B2 | 2/2011 | Underwood |
| 7,908,805 | B2 | 3/2011 | Metcalf |
| 7,913,459 | B2 | 3/2011 | Ball |
| 7,918,064 | B2 | 4/2011 | Singleton |
| 7,922,224 | B2 | 4/2011 | Arias |
| 7,984,598 | B2 | 7/2011 | Gosling |
| 8,015,766 | B2 | 9/2011 | Gosling |
| 8,015,767 | B2 | 9/2011 | Glick |
| 8,024,901 | B2 | 9/2011 | Gosling |
| 8,033,059 | B2 | 10/2011 | Contois |
| 8,033,068 | B2 | 10/2011 | Luttmann |
| 8,046,957 | B2 | 11/2011 | Towersey |
| 8,151,527 | B2 | 4/2012 | Gosling |
| 8,151,533 | B2 | 4/2012 | Krieger |
| 8,176,707 | B2 | 5/2012 | Gosling |
| 8,215,061 | B2 | 7/2012 | Gosling |
| 8,272,180 | B2 | 9/2012 | Glick |
| 8,307,591 | B2 | 11/2012 | Steinle |
| 8,322,102 | B2 | 12/2012 | Krieger |
| 8,393,122 | B2 | 3/2013 | Henriott |
| 8,441,782 | B2 | 5/2013 | Thomas |
| 8,474,193 | B2 | 7/2013 | Sutton |
| 8,479,026 | B2 | 7/2013 | Lakshmanan |
| 8,534,021 | B2 | 9/2013 | Liu |
| 8,601,749 | B2 | 12/2013 | Von Hoyningen Huene |
| 8,613,168 | B2 | 12/2013 | Von Hoyningen Huene |
| 8,615,936 | B2 | 12/2013 | Von Hoyningen Huene |
| 8,656,648 | B2 | 2/2014 | Liegeois |
| 8,683,745 | B2 | 4/2014 | Artwohl |
| D710,025 | S | 7/2014 | Johnson |
| 8,910,435 | B2 | 12/2014 | Feldpausch |
| D725,638 | S | 3/2015 | Hofman |
| 8,966,839 | B2 | 3/2015 | Rebman |
| 9,003,731 | B2 | 4/2015 | Gosling |
| D731,833 | S | 6/2015 | Fifield |
| 9,084,489 | B2 | 7/2015 | Gosling |
| 9,206,600 | B2 | 12/2015 | Von Hoyningen Huene |
| 9,284,729 | B2 | 3/2016 | Von Hoyningen Huene |
| 2001/0039774 | A1 | 11/2001 | Beirise |
| 2002/0053174 | A1 | 5/2002 | Barmark |
| 2002/0104271 | A1 | 8/2002 | Gallant |
| 2002/0108330 | A1 | 8/2002 | Yu |
| 2002/0121056 | A1 | 9/2002 | Von Hoyningen |
| 2002/0124514 | A1 | 9/2002 | Higgins |
| 2002/0129574 | A1 | 9/2002 | Newhouse |
| 2002/0144476 | A1 | 10/2002 | Mastelli |
| 2002/0157335 | A1 | 10/2002 | Vos |
| 2003/0005514 | A1 | 1/2003 | Kunkel |
| 2003/0060080 | A1 | 3/2003 | Rees |
| 2003/0089057 | A1 | 5/2003 | Wiechecki |
| 2003/0154673 | A1 | 8/2003 | Macgregor |
| 2003/0196388 | A1 | 10/2003 | Edwards |
| 2003/0221384 | A1 | 12/2003 | Burken |
| 2004/0010998 | A1 | 1/2004 | Turco |
| 2004/0020137 | A1 | 2/2004 | Battey |
| 2004/0035074 | A1 | 2/2004 | Stanescu |
| 2004/0093805 | A1 | 5/2004 | Underwood |
| 2004/0177573 | A1 | 9/2004 | Newhouse |
| 2005/0005527 | A1 | 1/2005 | Metcalf |
| 2005/0086871 | A1 | 4/2005 | MacGregor |
| 2006/0042141 | A1 | 3/2006 | Hansen |
| 2006/0048457 | A1 | 3/2006 | Yang |
| 2006/0059806 | A1 | 3/2006 | Gosling |
| 2006/0185276 | A1 | 8/2006 | Pai |
| 2007/0277449 | A1 | 12/2007 | Burns |
| 2007/0289225 | A1 | 12/2007 | Kern |
| 2008/0069632 | A1 | 3/2008 | Gosling |
| 2008/0168930 | A1 | 7/2008 | Calero |
| 2008/0295426 | A1 | 12/2008 | Milligan |
| 2008/0302054 | A1 | 12/2008 | Gosling |
| 2009/0021122 | A1 | 1/2009 | Green |
| 2009/0241437 | A1 | 10/2009 | Steinle |
| 2009/0260311 | A1 | 10/2009 | Boyer |
| 2009/0293406 | A1 | 12/2009 | Gosling |
| 2010/0043142 | A1 | 2/2010 | Whitford |
| 2010/0192511 | A1 | 8/2010 | Gosling |
| 2010/0223857 | A1 | 9/2010 | Sutton |
| 2010/0307086 | A1 | 12/2010 | Hibbs |
| 2011/0113692 | A1 | 5/2011 | Stamper |
| 2011/0197519 | A1 | 8/2011 | Henriott |
| 2012/0186164 | A1 | 7/2012 | Pensi |
| 2012/0317899 | A1 | 12/2012 | Von Hoyningen Huene |
| 2014/0102021 | A1 | 4/2014 | Gosling |
| 2014/0202361 | A1 | 7/2014 | Siwiec |
| 2014/0310873 | A1 | 10/2014 | Gosling |
| 2014/0338120 | A1 | 11/2014 | Baugh |
| 2015/0007516 | A1 | 1/2015 | Glick |
| 2015/0354212 | A1 | 12/2015 | Von Hoyningen Huene |
| 2016/0032644 | A1 | 2/2016 | Geller |
| 2016/0053485 | A1 | 2/2016 | Von Hoyningen Huene |

FOREIGN PATENT DOCUMENTS

| | | |
|---|---|---|
| CA | 2011977 | 10/1990 |
| CA | 2002674 | 5/1991 |
| CA | 2040822 | 11/1991 |
| CA | 2162300 | 5/1997 |
| CA | 2273631 | 10/2001 |
| CA | 2324050 | 4/2002 |
| CA | 2348060 | 11/2002 |
| CA | 2359165 | 4/2003 |
| CA | 2310869 | 8/2003 |
| CA | 2476368 | 1/2006 |
| CA | 2428593 | 8/2007 |
| CA | 2359547 | 2/2008 |
| CA | 2591176 | 12/2008 |
| CA | 2634407 | 12/2008 |
| CA | 2349964 | 10/2009 |
| CA | 2840843 | 12/2013 |
| CA | 2535213 | 4/2014 |
| CA | 2863783 | 4/2014 |
| CH | 686795 | 6/1996 |
| CN | 202069245 | 12/2011 |

(56) References Cited

FOREIGN PATENT DOCUMENTS

| | | |
|---|---|---|
| DE | 1659015 | 11/1971 |
| DE | 4207753 | 9/1993 |
| DE | 69316247 | 7/1998 |
| DE | 19960535 | 6/2001 |
| DE | 202004017808 | 1/2005 |
| EP | 0302564 | 2/1989 |
| EP | 0443202 | 8/1991 |
| EP | 0557092 | 1/1998 |
| EP | 0963719 | 12/1999 |
| EP | 1094167 | 4/2001 |
| EP | 2736382 | 6/2014 |
| FR | 1526637 | 5/1968 |
| GB | 1259347 | 1/1972 |
| GB | 1400613 | 7/1975 |
| GB | 2221946 | 2/1990 |
| GB | 2283071 | 4/1995 |
| GB | 2353541 | 10/2003 |
| JP | O317333 | 1/1991 |
| JP | 2003105908 | 4/2003 |
| JP | 2005155223 | 6/2005 |
| KR | 20000049102 | 7/2000 |
| KR | 1020070077502 | 7/2007 |
| WO | 9212074 | 7/1992 |
| WO | 9212300 | 7/1992 |
| WO | 9315970 | 8/1993 |
| WO | 9323629 | 11/1993 |
| WO | 9402695 | 2/1994 |
| WO | 9633323 | 10/1996 |
| WO | 9746770 | 12/1997 |
| WO | 9807357 | 2/1998 |
| WO | 9816699 | 4/1998 |
| WO | 9829623 | 7/1998 |
| WO | 9837292 | 8/1998 |
| WO | 9851876 | 11/1998 |
| WO | 9946453 | 9/1999 |
| WO | 9946455 | 9/1999 |
| WO | 9946458 | 9/1999 |
| WO | 9953156 | 10/1999 |
| WO | 9958780 | 11/1999 |
| WO | 9963177 | 12/1999 |
| WO | 0015918 | 3/2000 |
| WO | 0075447 | 12/2000 |
| WO | WO0171241 | 9/2001 |
| WO | 0208851 | 1/2002 |
| WO | 02052111 | 4/2002 |
| WO | 02103129 | 12/2002 |
| WO | WO03071045 | 8/2003 |
| WO | WO2003071045 | 8/2003 |
| WO | WO03104581 | 12/2003 |
| WO | WO2003104581 | 12/2003 |
| WO | 2005120294 | 12/2005 |
| WO | 2006127804 | 11/2006 |
| WO | 2010121788 | 10/2010 |
| WO | 2012173930 | 12/2012 |
| WO | 2013101298 | 7/2013 |
| WO | 2013130871 | 9/2013 |
| WO | 2013185141 | 12/2013 |
| WO | 2013188211 | 12/2013 |
| WO | 2013188235 | 12/2013 |
| WO | 2014039278 | 3/2014 |
| WO | 2014055883 | 4/2014 |

OTHER PUBLICATIONS

Restriction Requirement for U.S. Appl. No. 14/683,684 dated Oct. 5, 2017.

Notice of Allowance for U.S. Appl. No. 29/493,280 dated Jan. 21, 2016.

Canadian Office Action for Application No. 2,800,414 dated Jul. 15, 2015.

Genius Architectural Walls, [Publication Date Unlisted], Copyright Date 2004 by KI, Document Code KI-00473/HC/IT/PP/504.

KI Improves STC Rating on its Genius Architectural Wall and receives ICC approval, [Publication Date Unlisted], Dated Feb. 26, 2004.

Lifespace Environmental Wall Systems, [Publication Date Unlisted], Dated Apr. 1995.

Press Release—"KI unveils Genius Full Heigth Movable Wall Microsite with new interactive features", Accessed on Aug. 14, 2015 at http://web.archive.org/web/20040506230219/http://www.ki.com/about_press_release.asp?id=49.

Office Insight, [Publication Date Unlisted], Dated Mar. 23, 2009.

KI Genius Full-Height Moveable Walls, [Publication Date Unlisted], Copyright Date 2003 by KI, Document Code KI-00506/HC/PP/803.

U.S. Specifier Guide and Price Book, [Publication Date Unlisted], Dated Jan. 1998.

Achieving the Atkins Aesthetic: KI's new ThinLine option for its award-winning Genius Architectural Wall flaunts a slimmer figure, [Publication Date Unlisted], Dated Jun. 14, 2004.

SMED International—Lifespace—Technical Information, [Publication Date Unlisted], Dated Jan. 1, 1996.

Teknionaltos—Price and Product Guide Update, [Publication Date Unlisted], Dated Feb. 2002.

International Search Report and Written Opinion for PCT/US2012/042314 dated Jun. 13, 2012.

International Preliminary Report on Patentability for application PCT/US2012/042314 dated Jul. 10, 2014.

Notice of Allowance for U.S. Appl. No. 15/177,095 dated Nov. 16, 2017.

International Search Report for application No. EP17189630.1 dated Dec. 12, 2017.

Non-Final Office Action for U.S. Appl. No. 14/683,684 dated Apr. 23, 2018.

MODULAR WALLS WITH EMBEDDED FURNITURE AND OPPOSING FEATURE

CROSS-REFERENCE TO RELATED APPLICATIONS

The present application claims the benefit of priority to U.S. Provisional Patent Application No. 62/293,568, filed on Feb. 10, 2016, entitled "Embedded Furniture having Retractable Legs with Lighting," and to U.S. Provisional Patent Application No. 62/293,573, filed on Feb. 10, 2016, entitled "Modular Wall with Embedded Furniture and Opposing Feature," the entire content of each of which is incorporated herein by reference.

BACKGROUND

1. Technical Field

This disclosure generally relates to embedded furniture systems. More specifically, the present disclosure relates to (modular) wall-embedded furniture systems including, without limitation, recessed, extendable furniture, such as beds, tables, desks, sofas, and chairs.

2. Related Technology

Building space can be relatively expensive due to the basic costs associated with the location and size of the building. In addition to these costs, furnishing the interior space may add further expense. In a residential setting, for example, an owner or occupant may not be able to afford the size of residence they need and purchase furniture to fill the entire house. Similarly, in a commercial setting, sufficient floor space in an office building or warehouse may not be available within certain price ranges.

Extendable and/or embedded furniture may be built or incorporated into an interior wall or provided within a separate piece of housing furniture, such as a bookcase. Such embedded furniture may be selectively moveable between a storage position, in which the furniture is hidden (or stowed), and a utility position, in which the furniture is deployed. Some larger or bulky pieces of extendable furniture may require a furniture compartment with a depth sufficient to receive and conceal the furniture therein. Because the compartment is disposed in the wall or housing-furniture, the wall or housing-furniture typically has a similar or corresponding depth (or thickness) in order to conceal the compartment. Such thick walls may be expensive and unsightly and may occupy significantly more interior space than walls without embedded furniture.

Recent developments in modular wall systems have provided reconfigurable and/or interchangeable wall modules and components. Such systems may be designed to accommodate standard wall thickness, but not the increased thickness required for embedded furniture.

Accordingly, there are a number of disadvantages with conventional embedded furniture systems that can be addressed.

BRIEF SUMMARY

Implementations of the present disclosure solve one or more of the foregoing or other problems in the art with systems, methods, and apparatus for incorporating furniture into walls, and specifically into modular walls. In particular, one or more implementations can include an embedded furniture system comprising a furniture assembly and a concealing element disposed about a portion of the assembly. The assembly can include a furniture stowage component having a recessed compartment (or socket, pocket, etc.). For instance, the furniture stowage component can comprise a body having a furniture compartment recessed therein.

The assembly can also include a (selectively deployable) furniture element extending from (a first side of) the stowage component and/or selectively stowable at least partially within the compartment. For instance, the furniture element can be moveably (e.g., hingedly) connected to the stowage component (or body thereof). The furniture element can be selectively moveable between (i) a storage position (e.g., in which the furniture element is stowed or disposed in the compartment and/or in a substantially upright or vertical orientation and/or substantially parallel to a structural component) and (ii) a utility position (e.g., in which the furniture element is deployed and/or extends from the compartment and/or in a substantially horizontal orientation and/or substantially perpendicular to the structural component).

The concealing element can comprise a covering disposed about at least a portion of (an opposing second side of) the stowage component and/or covering a rear portion of the body. The concealing element can comprise a display element, such as a substantially hollow furniture component (or furniture-shaped covering) disposed about and substantially concealing the portion of the stowage component. In some implementations, the concealing element can comprise a piece of (artificial) furniture. For instance, the concealing element can comprise an outer covering that resembles (the exterior of) a piece of furniture.

In some implementations, the system can also include a structural component (e.g., (modular) wall element). The furniture assembly can extend through the structural component (e.g., such that a first side of the assembly is disposed on a first side of the structural component and a second side of the assembly is disposed on an opposing second side of the structural component). In at least one implementation, for instance, a surface of the first side of the assembly can be aligned (e.g., flush) with a first side of the structural component. The stowage component (or body thereof) can extend from an opposing second side of the structural component. Thus, the concealing element can substantially cover the portion of the stowage component (or body thereof) exposed on the opposing second side of the structural component. Accordingly, the structural component need not be thick enough to conceal the exposed portion of the stowage component (or body thereof).

This summary is provided to introduce a selection of concepts in a simplified form that are further described below in the Detailed Description. This Summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1A:
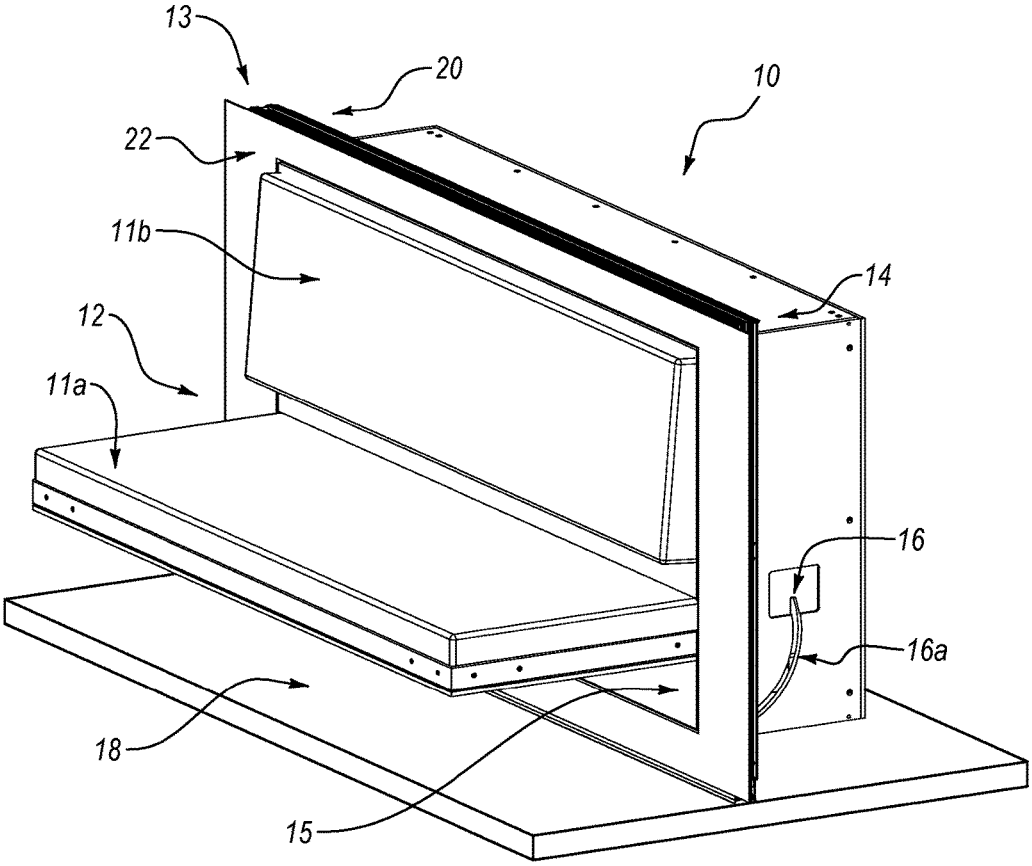
FIG. 1A illustrates a front perspective view of an embedded furniture system in a utility configuration according to an implementation of the present disclosure.

Before describing various implementations of the present disclosure in detail, it is to be understood that this disclosure is not limited to the parameters of the particularly exemplified systems, methods, apparatus, products, processes, and/or kits, which may, of course, vary. Thus, while certain implementations of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the implementations, and is not necessarily intended to limit the scope of the claimed invention.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the terms "embodiment" and "implementation" mean serving as an example, instance, or illustration, and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used herein, the term "systems" also contemplates devices, apparatus, compositions, assemblies, kits, and vice versa. Similarly, the term "method" also contemplates processes, procedures, steps, and vice versa. Moreover, the term "devices" also contemplates products, apparatus, compositions, assemblies, kits, and vice versa.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "seam" includes one, two, or more seams. Similarly, reference to a plurality of referents should be interpreted as comprising a single referent and/or a plurality of referents unless the content and/or context clearly dictate otherwise. Thus, reference to "seams" does not necessarily require a plurality of such seams. Instead, it will be appreciated that independent of conjugation; one or more seams are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," "joined," "communicating," or "in communication" are used to indicate either a direct association between two components or, where appropriate, an indirect association with one another through intervening or intermediate components. In contrast, when a component is referred to as being "directly bound," "directly coupled", "directly attached", "directly connected," "directly joined," "directly communicating," or "in direct communication" to or with another component, no intervening elements are present or contemplated. Furthermore, binding, coupling, attaching, connecting, joining, or communicating can comprise mechanical and/or electrical association.

To facilitate understanding, like reference numerals (i.e., like numbering of components and/or elements) have been used, where possible, to designate like elements common to the figures. Specifically, in the exemplary implementations illustrated in the figures, like structures, or structures with like functions, will be provided with similar reference designations, where possible. Specific language will be used herein to describe the exemplary implementations. Nevertheless it will be understood that no limitation of the scope of the disclosure is thereby intended. Rather, it is to be understood that the language used to describe the exemplary implementations is illustrative only and is not to be construed as limiting the scope of the disclosure (unless such language is expressly described herein as essential).

Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular implementation(s) in which they are illustrated. In other words, reference to a specific feature in relation to one implementation and/or embodiment should not be construed as being limited to applications only within said implementation.

The headings used herein are for organizational purposes only and are not meant to be used to limit the scope of the description or the claims.

The present disclosure extends to systems, methods, and apparatus for incorporating furniture into walls, and specifically into modular walls. In particular, one or more implementations include an embedded furniture system comprising a furniture assembly having an embedded and/or extendable furniture element disposed on a first side thereof and a concealing element (e.g., a substantially hollow and/or artificial furniture component or covering) on an opposing, second side thereof. The assembly can also comprise a furniture stowage component comprising a body or housing with an encircling side wall that at least partially bounds a (recessed) furniture compartment. Thus, the furniture element can be embedded in the furniture stowage component and the assembly (or at least a portion of the assembly) can be embedded in the concealing element.

The furniture assembly can be disposed in and/or extend through a structural component such as an interior wall (or wall component) of a building. In at least one implementation, the wall can comprise a modular wall or wall module (or component) thereof. The (modular) wall component can have an industry standard and/or a minimal thickness in some embodiments. Accordingly, the rear portion of the stowage component (or body thereof) can extend from the back side of the wall and/or be exposed thereon.

The embedded furniture element can move between (i) a closed, storage position (e.g., in which the furniture element is hidden, stowed, or disposed in the compartment and/or in a substantially upright or vertical orientation and/or substantially parallel to a structural component) and (ii) an open or extended, utility position (e.g., in which the furniture element is deployed and/or extends from the compartment and/or in a substantially horizontal orientation and/or substantially perpendicular to the structural component). When in the storage position, the furniture element can be substantially concealed within the compartment.

The embedded furniture element can comprise any type of furniture suitable and/or amenable to extendable, embedded configuration. For instance, the embedded furniture element can comprise embedded sleep furniture (e.g., a bed or (bunk) beds), seating furniture (e.g., a chair, couch, bench, etc.), surface or work station furniture (e.g., a desk, table, etc.), decorative, display, or storage furniture (e.g., a cabinet, drawer, buffet, shelf, etc.), or other furniture. Indeed, one will appreciate in light of the disclosure herein that the systems, apparatus, and methods can allow for incorporation of a wide variety of furniture elements within a (modular) wall system.

In addition, the opposing concealing element can comprise a (substantially hollow) furniture component (or covering). The furniture component can comprise any type of furniture suitable and/or amenable to substantially concealing an understructure. For instance, the opposing furniture component can comprise a covering that resembles (the exterior of) a (substantially block) piece of furniture. Such block furniture can include, for example, a drawer, buffet, cabinet, couch, loveseat, chair, or other furniture capable of concealing matter therein.

In certain implementations, the concealing element can substantially conceal the (body of) the furniture stowage component such that the wall component need not be sized to conceal the stowage component. For instance, the wall can be sized according to industry standards for interior walls, instead of being thicker. Accordingly, implementations of the present disclosure can have an artificial or false furniture component that covers the rear body portion of a recessed furniture stowage component. Thus, implementations of the present disclosure can provide aesthetic appeal to embedded furniture systems, such that the wall to which the embedded furniture element is attached need not be thick enough to conceal the (entire) stowage component, without the stowage component being exposed on the opposing side of the wall.

In at least one implementation, a furniture system can include an actuating mechanism connected between the furniture element and the structural component. The actuating mechanism can provide a mechanical advantage for moving the furniture element from the utility position into the storage position. In certain implementations, the actuating mechanism comprises a hinge element, such as a (gas) piston, spring, shock, or strut, connected to the furniture element and the structural component. The actuating mechanism can also comprise an (electric) actuating member (or motor) configured to selectively move the furniture element between the utility position and the storage position. In certain implementations, at least a portion of the actuating mechanism can be substantially concealed and/or disposed outside the recessed compartment. For instance, the hinge element and/or actuating member can be disposed within the concealing element and/or opposite the recessed compartment, such as between the concealing element and the outer surface of the socket component.

Throughout this specification, reference may be made to wall modules or modular wall systems. A wall module can comprise an individual section of a modular wall system which a manufacturer can attach and remove independently of other wall module sections of the modular wall system. For example, an existing installed wall system that does not include a wall module having embedded and/or extendable furniture may be retrofitted with a wall module having embedded and/or extendable furniture according to one or more implementations of the present disclosure. In particular, a user can replace an existing wall module in the installed wall without requiring the disassembly of the entire wall system. The disclosure, however, is not limited to retrofitting existing walls, but also extends to modular wall installations that include wall modules having embedded and/or extendable furniture at the time of initial installation. Furthermore, embodiments extend to permanent wall embedded furniture systems, apparatus, and methods.

Figure 1B:
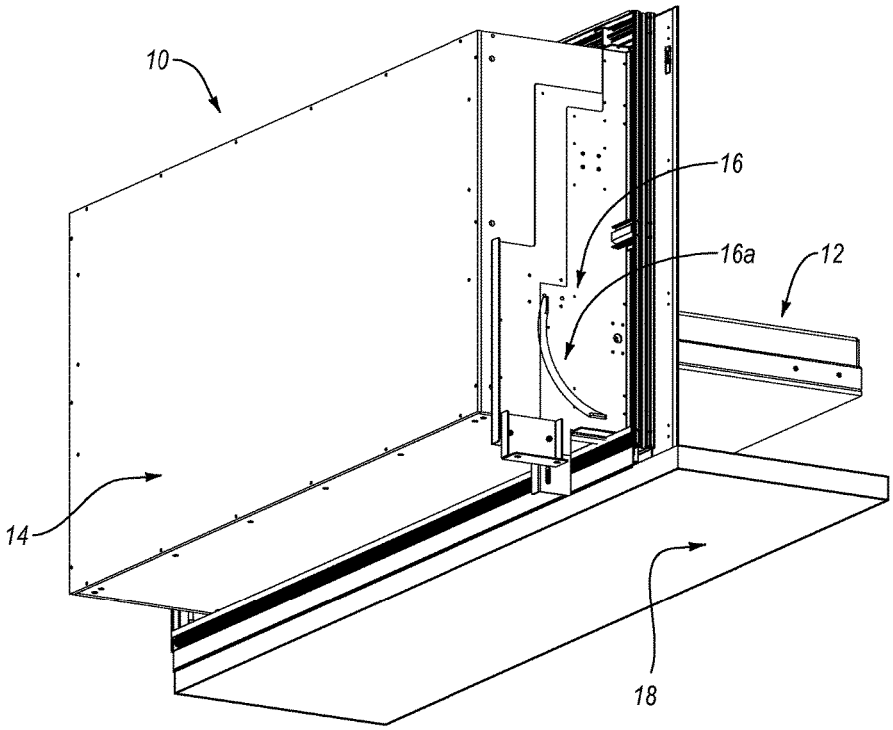
FIG. 1B illustrates a rear perspective view of the embedded furniture system of FIG. 1A.

Reference will now be made to the figures of the present disclosure. For example, FIG. 1A and FIG. 1B illustrate an embedded furniture system 10 in a utility configuration according to an implementation of the present disclosure. Embedded furniture system 10 can comprise a furniture assembly that includes a furniture stowage component 14 having a recessed compartment 15 and a furniture element 12 extending from stowage component 14. The furniture assembly extends through a structural component 13.

Structural component 13 can comprise a (modular) wall module or assembly, comprising, for example, a structural (or frame) element 20 (e.g., to which stowage component 14 can be mounted) and a display (or outer wall) element and/or surface 22 (e.g., attached to structural (or frame) element 20). For instance, in at least one implementation, display (or outer wall) element and/or surface 22 can be or comprise (or be a component of) a modular wall panel. The wall panel can be mounted to the front (furniture) side of structural (or frame) element 20. In addition, a corresponding wall panel (or display (or outer wall) element and/or surface) can be mounted to the back or rear (stowage component) side of structural (or frame) element 20.

In some implementations, structural component 13, structural (or frame) element 20, and/or display element and/or surface 22 can comprise a modular wall component configured to integrate the furniture assembly into a modular wall system. For instance, the modular wall component can be incorporated into a wall module or modular wall system thereof. Accordingly, embedded furniture system 10 can extend through and/or include a structural wall component in one or more embodiments.

Furniture element 12 can comprise a folding sofa (or padded bench), as illustrated in FIG. 1A. Those skilled in that art will appreciate, however, that furniture element 12 can be or comprise any piece of furniture suitable for selective stowage and deployment from stowage component 14 and/or recessed compartment 15 thereof. Furniture element 12 includes a base or bottom portion 11*a* and a back (rest) 11*b*. In the deployed configuration illustrated in FIG. 1A and FIG. 1B, bottom portion 11*a* is in a substantially horizontal orientation.

Furniture element 12 is movably connected to stowage component 14 such that furniture element 12 is selectively stowable within compartment 15. For instance, furniture system 10 can include an actuating mechanism 16 to provide movability and/or mechanical advantage in stowing furniture element 12 in compartment 15 (e.g., by raising or lifting up (on a front end of) base 11*a*). The actuating mechanism 16 can include one or more (e.g., opposing) hinge elements 16*a*, which can direct furniture element 12 (or component(s) thereof) into a proper storage position. The actuating mechanism 16 can also include one or more springs, pistons, shocks, struts, and/or other biasing members for providing mechanical advantage.

Figure 2:
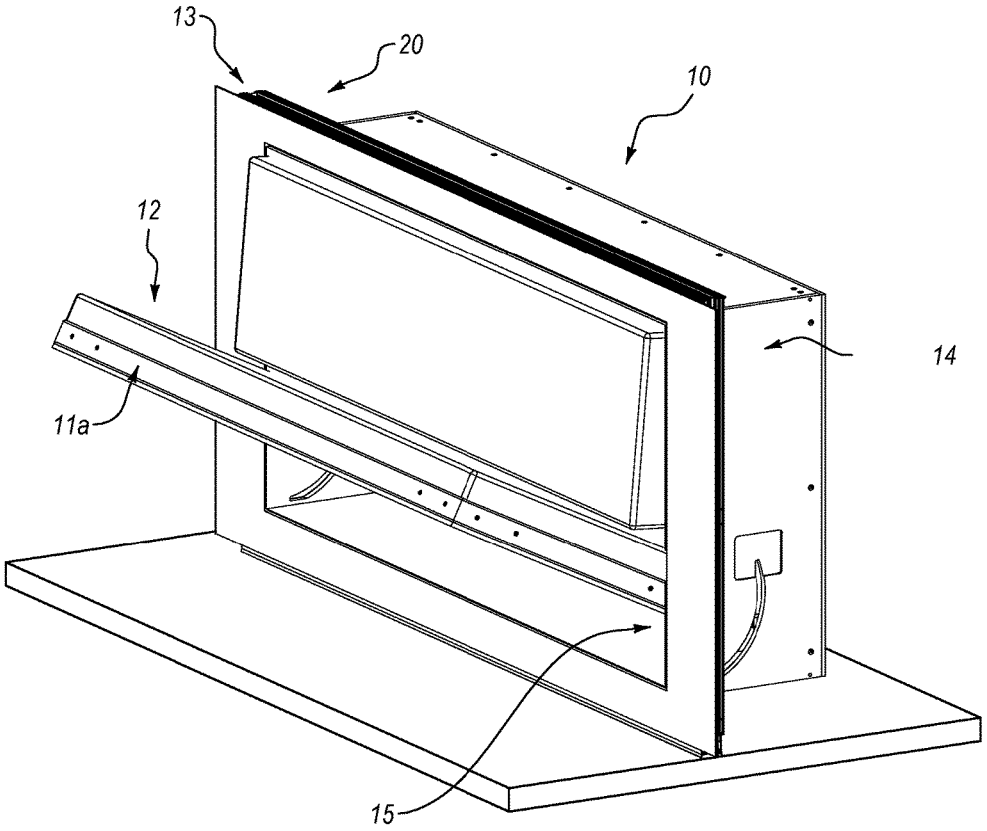
FIG. 2 illustrates a front perspective view of the embedded furniture system of FIG. 1A in a first transition configuration.
Figure 3:
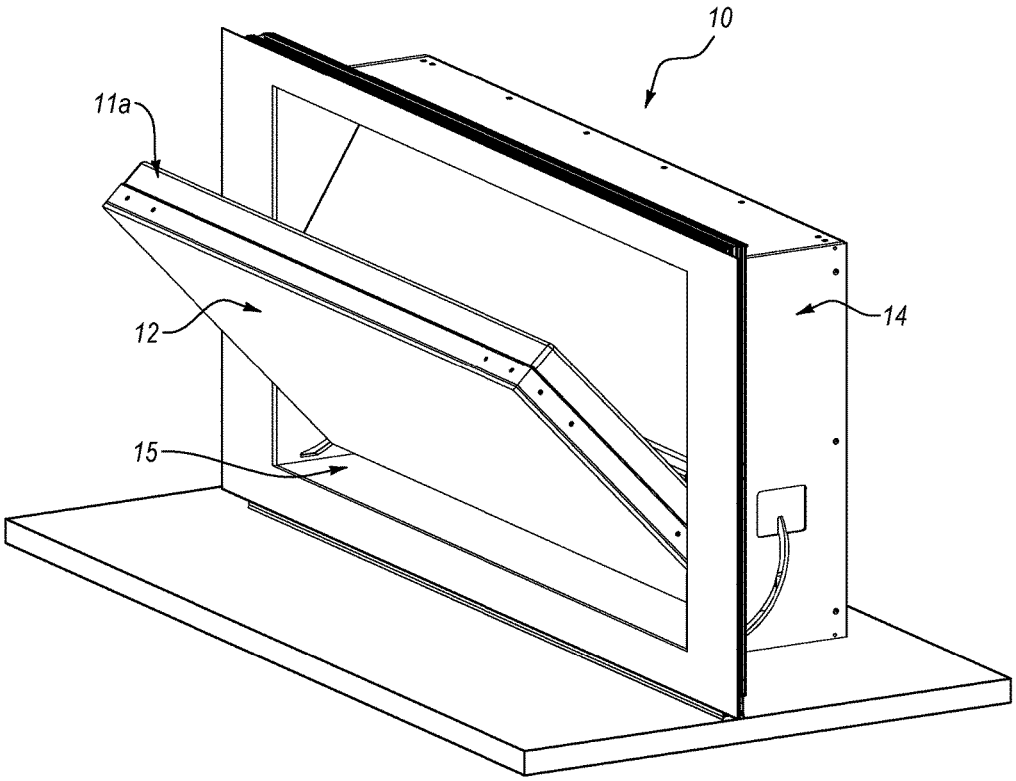
FIG. 3 illustrates a front perspective view of the embedded furniture system of FIG. 1A in a second transition configuration.

Furniture system 10 can be disposed above and/or adjacent to a floor 18. Accordingly, in at least one implementation, furniture element 12 does not necessarily contact the floor 18 in the deployed position and/or storage position. As illustrated in FIG. 2 and FIG. 3, furniture element 12 can be actuated from the deployed position through one or more transitional configurations. In particular, by lifting up on bottom portion 11*a*, furniture element 12 can begin moving and/or embedding into compartment 15 of stowage component 14. FIG. 2 also illustrates a structural support (or frame) element 20 of structural component 13. Accordingly, structural component 13 can provide structural support and/or rigidity to furniture system 10.

Figure 4A:
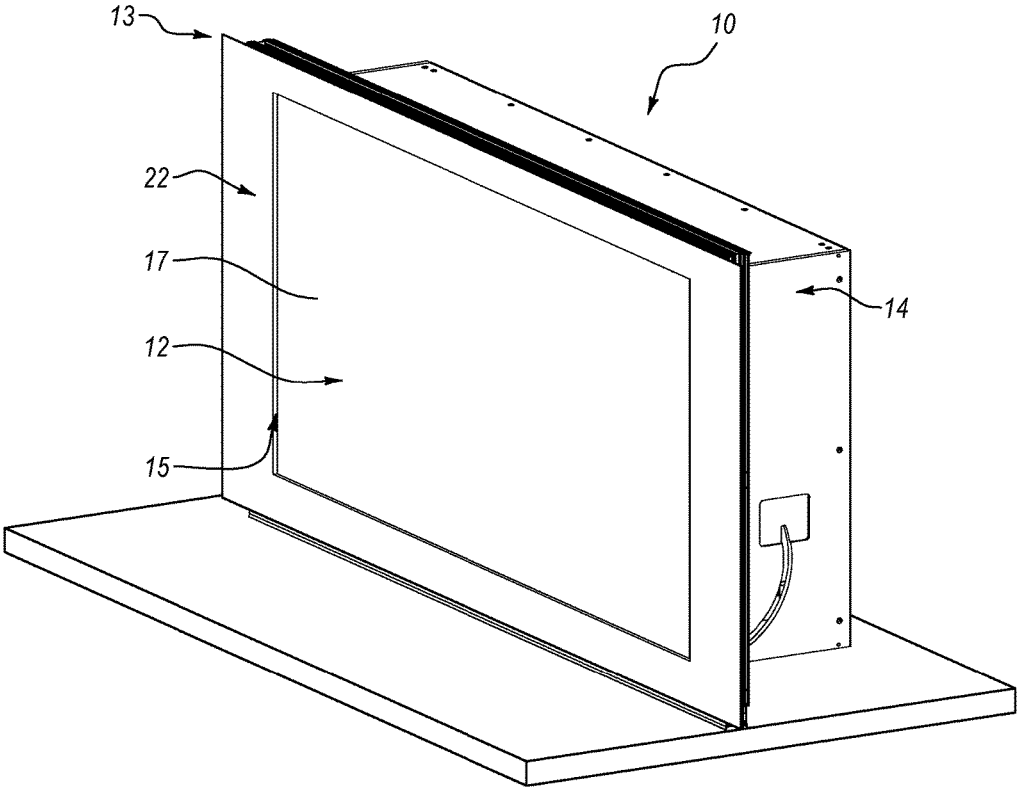
FIG. 4A illustrates a front perspective view of the embedded furniture system of FIG. 1A in a storage configuration.

As illustrated in FIG. 4A, furniture element 12 can be (fully) stowed within compartment 15 of stowage component 14 (e.g., such that only an outer surface 17 of furniture element 12 is exposed on structural component 13). In addition, in a fully stowed configuration, outer surface 17 can be substantially aligned and/or flush with a front side, wall component, and/or surface 22 of structural component 13. Accordingly, furniture element 12 can be substantially and/or completely concealed within compartment 15 of stowage component 14 (e.g., such that only outer surface 17 is visible.

Figure 4B:
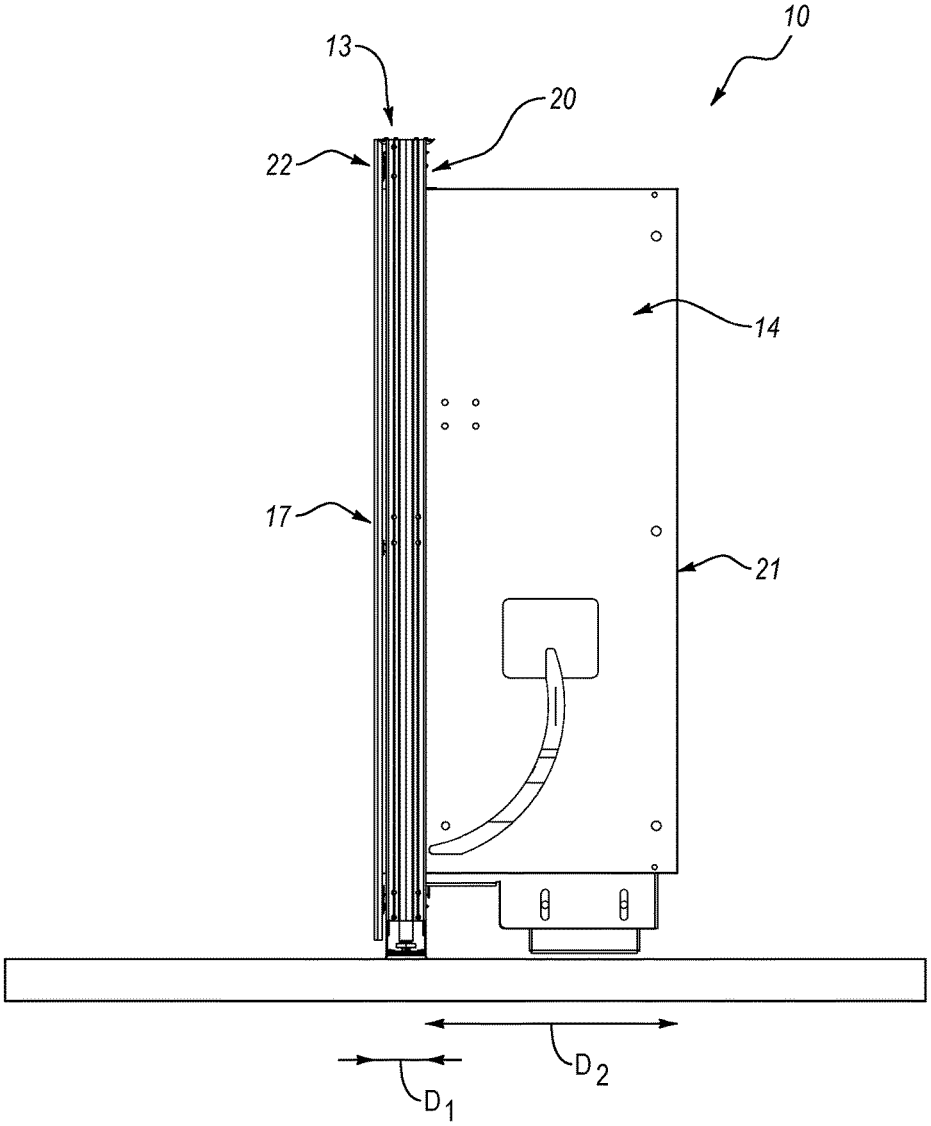
FIG. 4B illustrates a side elevation view of the embedded furniture system of FIG. 4A.

As illustrated in FIG. 4B, however, the body of stowage component 14 can extend from the rear or back side of structural component 13. Thus, while outer surface 17 of furniture element 12 and/or front surface 22 of structural component 13 can comprise aesthetic display components suitable for being visually-exposed in a room, a rear side and/or surface 21 of the body of stowage component 14 can be structural and/or aesthetically unpleasing in nature. Accordingly, stowage component 14 and/or rear side or surface 21 (of the body portion) thereof, as well as structural component 13 may also need to be concealed and/or structurally supported or mounted within the room. Structural component 13 can have a first depth D1 and stowage component 14 or the body portion thereof can have a second depth D2, both of which may need to be (entirely) covered, concealed, and/or structurally supported or mounted.

Figure 4C:
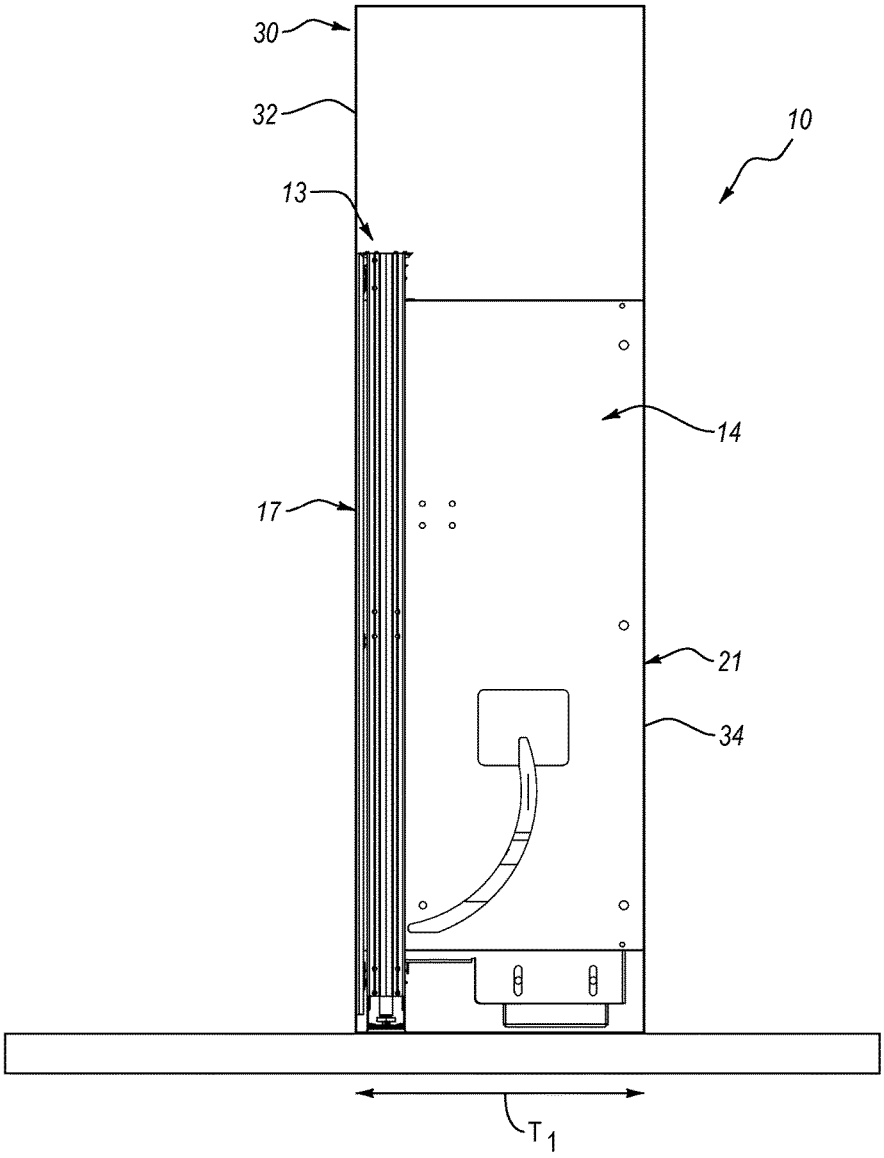
FIG. 4C illustrates a schematic view of the embedded furniture system of FIG. 4A in a wall environment.

FIG. 4C depicts one implementation for concealing and/or structurally supporting or mounting furniture system 10, the furniture assembly, or stowage component 14 thereof within a wall. Specifically, a full wall 30 can be provided with a depth or thickness T1 sufficient to extend from the front of furniture system 10 (or outer surface 17 and/or front surface 22) to the back of furniture system 10 (or rear surface 21) and/or to span or cover first depth D1 and second depth D2 (see FIG. 4B). Accordingly, a front side or surface 32 of wall 30 can cover and/or conceal (or be (at least) aligned with) outer surface 17 of furniture element 12 and/or front side or surface 22 of structural component 13. For instance, furniture system 10 can be disposed (e.g., inserted) into an opening in wall 30, such that outer surface 17 of furniture element 12 and/or front side or surface 22 of structural component 13 are displayed on or at front side or surface 32 of wall 30. Moreover, a rear side or surface 34 of wall 30 can cover and/or conceal rear side or surface 21 (of the body portion) of stowage component 14. In particular, stowage component 14 can be substantially and/or entirely disposed, enclosed, and/or concealed within full wall 30.

Figure 4D:
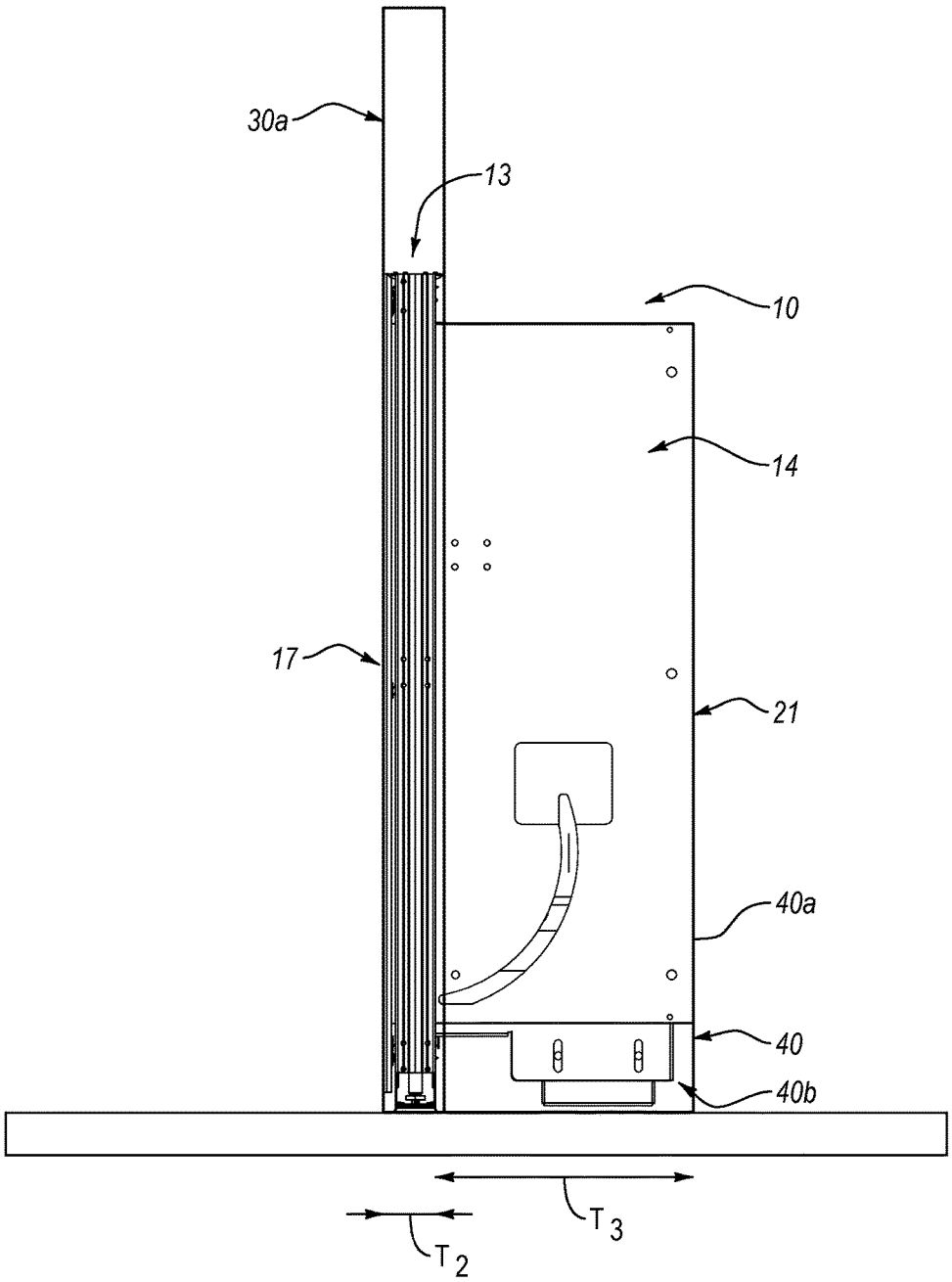
FIG. 4D illustrates a schematic view of the embedded furniture system of FIG. 4A in a modular wall display environment.

As illustrated in FIG. 4D, however, certain implementations of the present disclosure can conceal stowage component 14 without surrounding furniture system 10 in a full wall. Specifically, a feature, such as an aesthetic or (artificial) furniture (or display) component, can conceal (at least a (rear) portion of) stowage component 14. For instance, as described in further detail below, stowage component 14 can be substantially covered by or concealed by or within a concealing element 40.

As indicated above, structural component 13 can be or comprise a (modular) wall module or component. As depicted in FIG. 4D, structural component 13 can also (or alternatively) be installed or incorporated into and/or be disposed within a (modular) wall element 30*a*. Wall element 30*a* (and/or structural component 13) can have a thickness T2 (e.g., extending (or sufficient to extend) from the front (surface 22) of furniture system 10 or structural component 13 to stowage component 14 or the rear of structural component 13). Accordingly, thickness T2 can be substantially smaller than thickness T1 (see FIG. 4C), such that stowage component 14 extends from the back side of wall element 30*a* (and/or structural component 13). Thus, structural component 13 can be disposed within wall element 30*a* and stowage component 14 can be disposed within concealing element 40.

Concealing element 40 is provided to (entirely or substantially) conceal the extending (portion of) stowage component 14. For instance, concealing element 40 can have or comprise an outer covering 40*a* and/or a cavity 40*b* (e.g., disposed within covering 40*a*). At least a portion of stowage component 14 can be disposed within cavity 40*b*. Concealing element 40 can have a depth or thickness T3 sufficient to extend from the back side of wall element 30*a* (or structural component 13) to or past the back side 21 of stowage component 14. Thus, structural component 13 can be (or be disposed within) wall element 30*a* and stowage component 14 can be disposed within concealing element 40.

Stowage component 14 can be attached to structural component 13 (or frame element 20 thereof). In some embodiments, structural component 13 (or wall element 30*a*) can comprise a (second) wall panel connected to an opposing second side of frame element 20. The body portion of stowage component 14 can extend from or beyond the second wall panel. Concealing element 40 can abut and/or be connected to the second wall panel.

Concealing element 40 can be or comprise any suitable covering sufficient to and/or capable of substantially covering or concealing stowage component 14. For instance, concealing element 40 can be or comprise a furniture-shaped covering disposed about and substantially concealing the portion of stowage component 14 that extends from wall element 30*a* (or structural component 13). Concealing element 40 can comprise a false and/or substantially hollow piece of furniture or furniture component. For instance, concealing element 40 comprises a buffet-, armoire-, or other furniture-shaped covering with a hollow cavity therein for concealing stowage component 14. Those skilled in the art will appreciate, however, that concealing element 40 can be or comprise any suitable covering sufficient to and/or capable of substantially concealing the portion of stowage component 14 that extends from wall element 30*a*. Thus, concealing element 40 can comprise a (furniture-shaped) covering disposed about and substantially concealing the portion of (the body of) stowage component 14 that extends from wall element 30*a* (or structural component 13).

Concealing element 40 can be attached and/or connected to a rear side or surface of wall element 30*a* opposite a front display surface of wall element 30*a*. The front display surface can be substantially aligned with surface 17 of furniture element 12 and/or front surface 22 of structural component 13. In other implementations, the front display surface need not (necessarily) be substantially aligned with surface 17 of furniture element 12. It will also be appreciated that front surface 22 of structural component 13 need not (necessarily) be aligned and/or flush with the front surface of wall element 30*a* and/or surface 17 of furniture element 12 (e.g., in the stored or storage position or configuration).

Figure 5A:
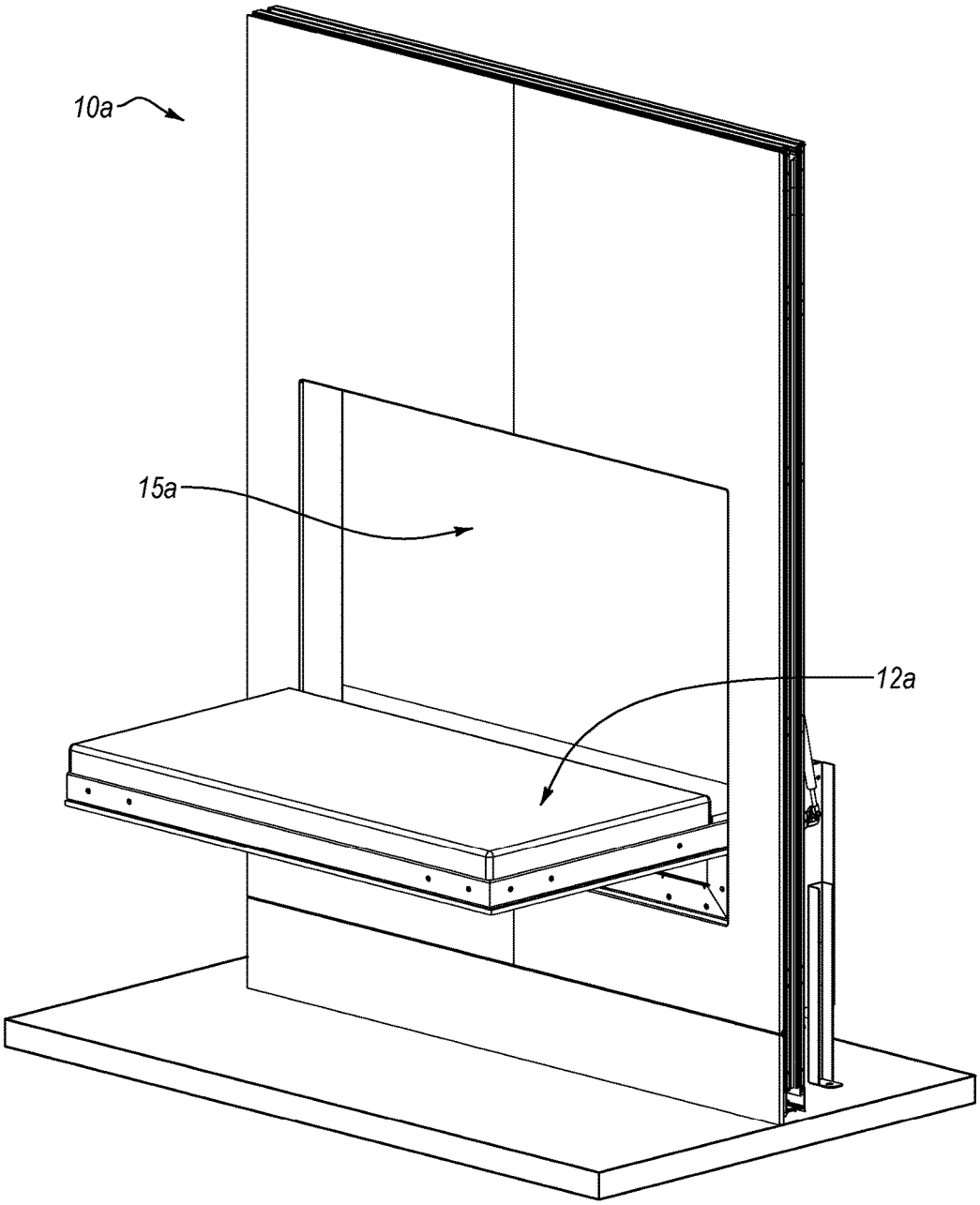
FIG. 5A illustrates a front perspective view of an embedded furniture system in a utility configuration according to another implementation of the present disclosure.
Figure 5B:
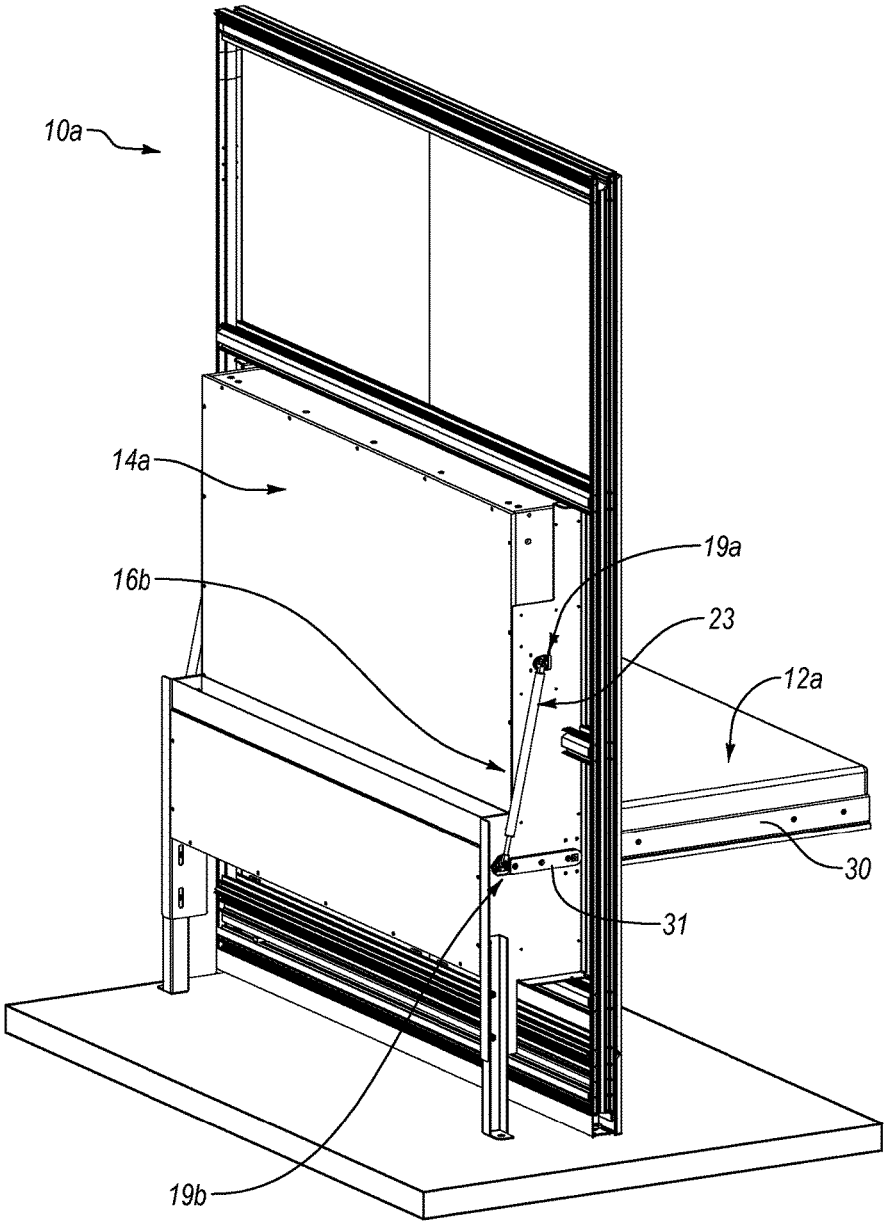
FIG. 5B illustrates a rear perspective view of the embedded furniture system of FIG. 5A.
Figure 5C:
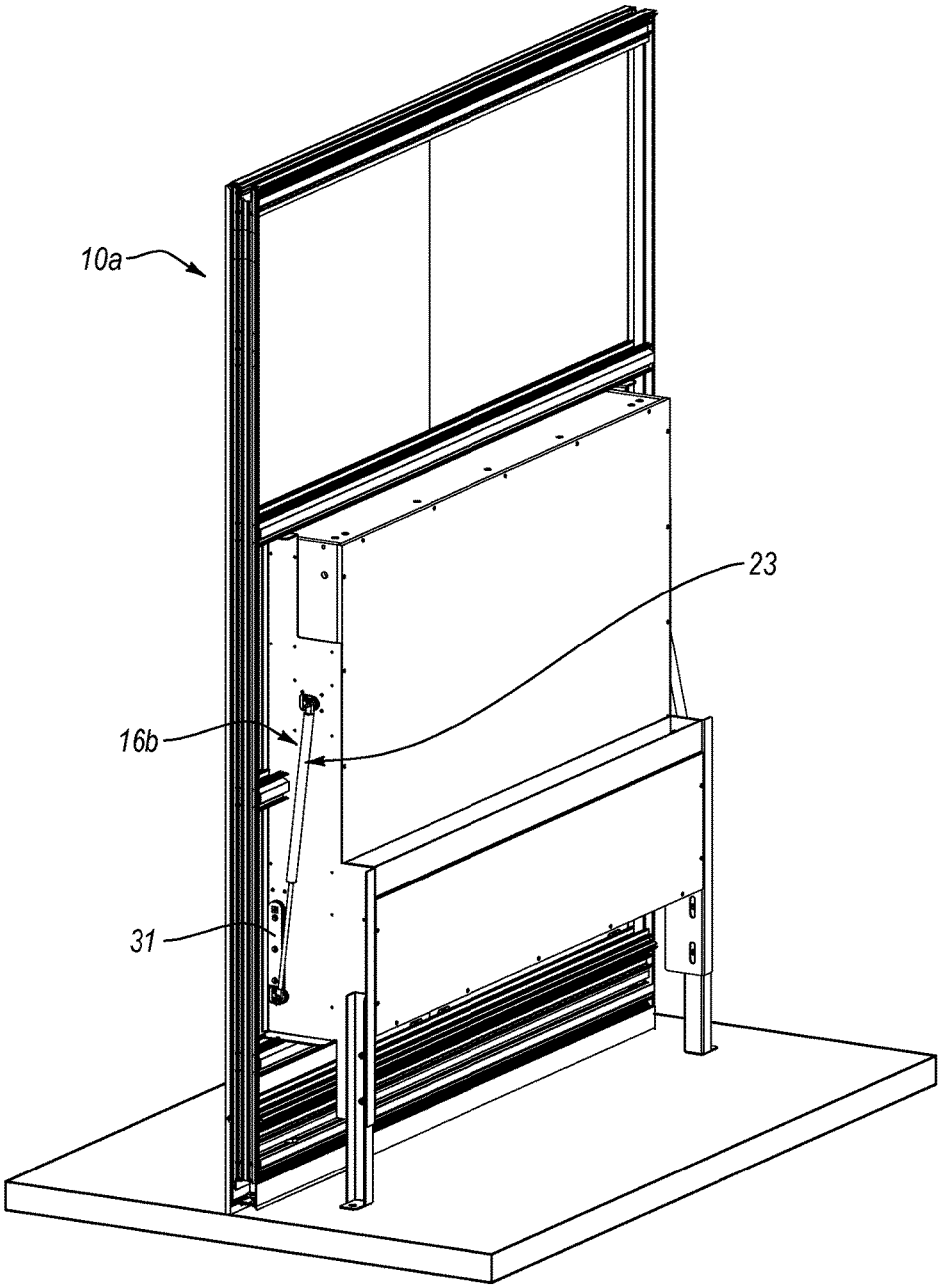
FIG. 5C illustrates a rear perspective view of the embedded furniture system of FIG. 5A in a storage configuration.

In at least one implementation, the furniture system can include a concealed actuating mechanism (or portion thereof). As depicted in FIGS. 5A-5C, for example, an embedded furniture system 10*a* can comprise a recessed compartment or pocket 15*a* and a furniture element 12*a* extending from pocket 15*a*. As depicted, furniture element 12*a* can comprise a workbench, shelf, table, desk, seat, etc. It is noted that a furniture actuating mechanism (or component thereof) is not visible within pocket 15*a*. As illustrated in FIG. 5B, furniture system 10*a* can include a (concealable or concealed) actuating mechanism 16*b*. Actuating mechanism 16*b* can comprise a piston element 23. Piston element 23 can comprise a (gas) piston or strut, as depicted, or a spring, hinge, pulley, gear, or other element, in other implementations.

Piston element 23 can be connected to a stowage component 14*a* (or outer surface thereof) by means of a fastener 19*a*, such as an anchor, bracket, bolt, etc. Piston element 23 can also be connected to a connection component 31 by means of a fastener 19*b*. Connection component 31 can be attached to furniture element 12*a* (or a frame element 30 thereof). Moreover, in the utility position illustrated in FIGS. 5A and 5B, piston element 23 and connection component 31 can be disposed in a first (substantially horizontal and/or (spring) loaded) configuration (e.g., allowing furniture element 12*a* to extend from socket component 14*a* or compartment 15*a* thereof).

Fastener 19*a* and/or 19*b* can secure piston element 23 and, optionally, allow a degree of rotation. For instance, as depicted in FIG. 5C, furniture system 10*a* (or actuating mechanism 16*b* thereof) can be actuated into a storage position. In the depicted storage position, piston element 23 and connection component 31 can be disposed in a second (substantially vertical and/or unloaded) configuration (e.g., allowing furniture element 12*a* to be stowed within recessed pocket 15*a* of stowage component 14*a*).

Figure 6:
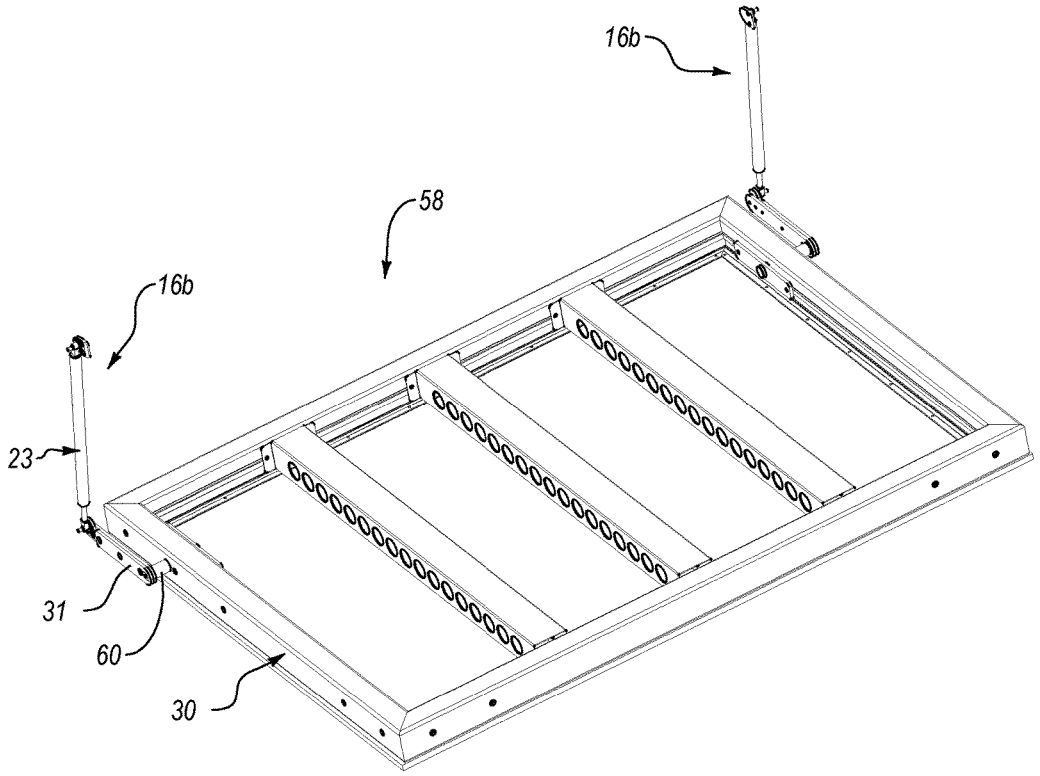
FIG. 6 illustrates a perspective view of a frame assembly according to an implementation of the present disclosure.
Figure 7:
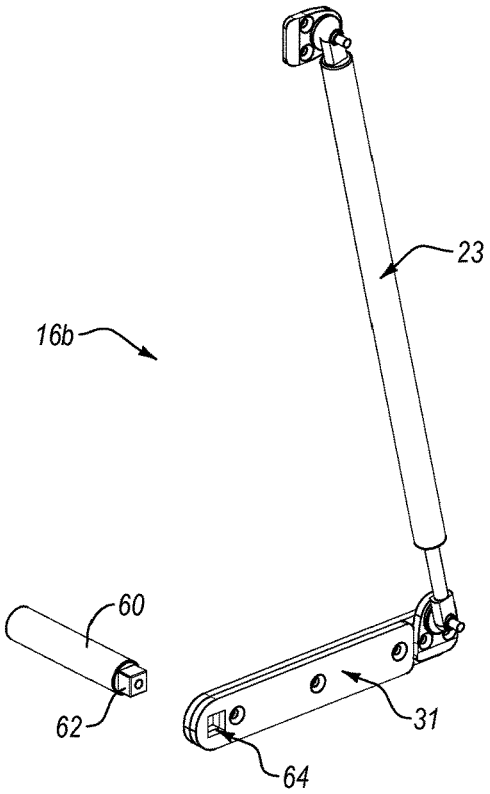
FIG. 7 illustrates a partial exploded view of a gas piston assembly according to an implementation of the present disclosure.

FIG. 6 illustrates a frame assembly 58 according to an implementation of the present disclosure. Frame assembly 58 can comprise furniture element frame component 30 (e.g., having an outer perimeter frame and, optionally, one or more inner frame elements), actuating mechanism 16*b* (e.g., including one or more (opposing) piston elements 23 and connection component 31), and/or an attachment element 60 connecting frame component 30 to connection component 31. As illustrated in FIG. 7, attachment element 60 can have an attachment member 62 configured to interface with a connection member 64 of connection component 31 (such as with a socket (lock-and-key) fit). In at least one implementation, attachment member 62 can comprise a (unitary) piece of attachment element 60. For instance, attachment element 60 can be or comprise a machined (steel) hub rod in some implementations.

Attachment element 60 (or attachment member 62 thereof) and connection component 31 can be secured together by one or more fasteners (not shown). Attachment element 60 can also be secured to furniture element 12*a* (or frame component 30 thereof).

Figure 8:
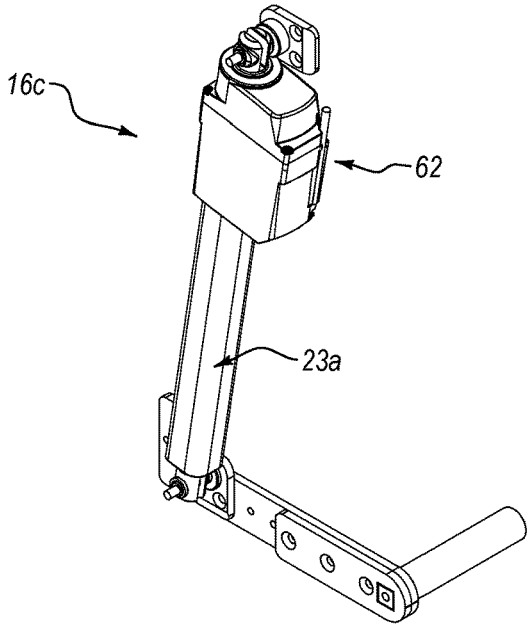
FIG. 8 illustrates a perspective view of an actuator assembly according to another implementation of the present disclosure.

FIG. 8 depicts an alternative actuating mechanism 16*c*. Actuating mechanism 16*c* comprises a piston element 23*a*, comprising a (gas) piston or strut and an (electric) actuating element 62. Actuating element 62 can comprise an electric motor or other means for operating (or extending and/or retracting) actuating element 23*a*. Electric actuating element 62 can also be electrically coupled to a power source or supply, such as a battery or electric wire.

In at least one alternative implementation, the furniture element need not be (moveably) connected to the stowage component. For instance, the furniture element can alternatively comprise a (separate) furniture or other component, such as a sofa (e.g., couch or loveseat). The (separate) furniture or other component can be selectively stowable in and deployable from the furniture compartment, such as by sliding along the floor. Accordingly, certain implementations can include a stowage component having a (storage) compartment and a rear body portion (e.g., extending through a wall element (or structural component)). Implementations can also include a concealing element configured to (substantially or entirely) cover or conceal a portion of (the rear body portion of) the stowage component (extending from the wall element (or the structural component)). An internal surface of the compartment can also be covered with a wall covering to provide aesthetic appeal or continuity.

One will appreciate that implementations of the present disclosure can provide a wide variety of (modular) wall systems that provide a wide variety of benefits. For example, implementations of the present disclosure can provide a wall module having recessed, extendable furniture that is incorporated into the wall. In particular, certain implementations can include an embedded furniture system that includes a selectively extendable, retractable, and/or reconfigurable piece of furniture with a selectively extendable, retractable, and/or reconfigurable illuminating structural support element.

Various alterations and/or modifications of the inventive features illustrated herein, and additional applications of the principles illustrated herein, which would occur to one skilled in the relevant art and having possession of this disclosure, can be made to the illustrated implementations without departing from the spirit and scope of the invention as defined by the claims, and are to be considered within the scope of this disclosure. Thus, while various aspects and implementations have been disclosed herein, other aspects and implementations are contemplated. While a number of methods and components similar or equivalent to those described herein can be used to practice implementations of the present disclosure, only certain components and methods are described herein.

It will also be appreciated that systems, processes, and/or products according to certain implementations of the present disclosure may include, incorporate, or otherwise comprise properties or features (e.g., components, members, elements, parts, and/or portions) described in other implementations disclosed and/or described herein. For instance, various features (e.g., actuating mechanisms 16, 16*b*, 16*c*, wall (element) 30, 30*a*, etc.) described herein in relation to one implementation can be (interchangeably) substituted in other implementations of the present disclosure. Accordingly, the various features of certain implementations can be compatible with, combined with, included in, and/or incorporated into other implementations of the present disclosure. Thus, disclosure of certain features relative to a specific implementation of the present disclosure should not be construed as limiting application or inclusion of said features to the specific implementation. Rather, it will be appreciated that other implementations can also include said features without necessarily departing from the scope of the present disclosure.

Moreover, unless a feature is described as requiring another feature in combination therewith, any feature herein may be combined with any other feature of a same or different implementation disclosed herein. Furthermore, various well-known aspects of illustrative systems, processes, products, and the like are not described herein in particular detail in order to avoid obscuring aspects of the example implementations. Such aspects are, however, also contemplated herein.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain implementations and details have been included herein and in the attached disclosure for purposes of illustrating implementations of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

We claim:

1. An embedded furniture system, comprising:

a furniture assembly comprising:

a furniture stowage component having a recessed compartment; and a furniture element selectively stowable at least partially within the compartment;

a concealing element disposed about a portion of the stowage component;

a wall element, wherein:

the stowage component is connected to or extends at least partially through the wall element;

the wall element comprises a wall module comprising a frame element and a first wall panel connected to a first side of the frame element; and a body portion of the stowage component extends from a second side of the frame element, the second side being opposite the first side.

2. The embedded furniture system of claim 1, wherein the concealing element comprises a furniture feature having a cavity, the portion of the stowage component being disposed within the cavity.

3. The embedded furniture system of claim 1, wherein the stowage component is attached to the frame element.

4. The embedded furniture system of claim 1, wherein the wall element further comprises a second wall panel connected to an opposing second side of the frame element, the body portion of the stowage component extending from or beyond the second wall panel.

5. The embedded furniture system of claim 4, wherein the concealing element abuts or is connected to the second wall panel, such that the concealing element covers the portion of the stowage component.

6. The embedded furniture system of claim 1, wherein the furniture element is connected to the furniture stowage component and is selectively moveable between a storage position and a utility position, wherein in the storage position, the furniture element is disposed at least partially within the compartment, and in the utility position, at least a portion of the furniture element extends outside of the compartment.

7. The embedded furniture system of claim 6, further comprising:

an actuating mechanism connected between the furniture element and the stowage component, wherein the actuating mechanism:

(i) directs the furniture element between the utility position into the storage position; and (ii) provides a mechanical advantage for moving the furniture element from the utility position into the storage position.

8. The embedded furniture system of claim 7, wherein:

the actuating mechanism comprises an electric actuating member configured to selectively move the furniture element between the utility position and the storage position.

9. The embedded furniture system of claim 7, wherein:

the actuating mechanism comprises a piston or strut connected to the furniture element and the stowage component;

the stowage component has (i) an inner surface that at least partially bounds the compartment, and (ii) an outer surface disposed opposite the compartment, and wherein the piston or strut is disposed at and connected to the outer surface.

10. The embedded furniture system of claim 9, wherein the actuating mechanism, or piston or strut thereof, is concealed within the compartment.

11. The embedded furniture system of claim 9, wherein the actuating mechanism, or piston or strut thereof, is substantially unperceivable within the compartment.

12. An embedded furniture system, comprising:

a wall component, the wall component comprising:

a frame element having opposing first and second sides;

a first wall panel connected to the first side of the frame element; and a second wall panel connected to the second side of the frame element;

a furniture assembly extending through the wall component, the assembly comprising:

a furniture stowage component comprising a body having a furniture compartment recessed therein, at least a portion of the body extending from the second side of the frame element; and a furniture element extending from the stowage component on the first side of the frame element, wherein the furniture element is selectively stowable at least partially within the compartment and deployable therefrom, wherein the furniture element is connected to the furniture stowage component and selectively moveable between a storage position and a utility position, wherein in the storage position, the furniture element is disposed at least partially within the compartment, and in the utility position, at least a portion of the furniture element extends outside of the compartment; and a concealing element disposed about and substantially concealing the portion of the body extending from the second side of the frame element, wherein the concealing element comprises a furniture-shaped covering having a cavity disposed therein, wherein the portion of the body is disposed within the cavity.

13. The embedded furniture system of claim 12, further comprising:

an actuating mechanism connected between the furniture element and the stowage component, wherein the actuating mechanism:

(i) directs the furniture element between the utility position into the storage position; and (ii) provides a mechanical advantage for moving the furniture element from the utility position into the storage position.

14. The embedded furniture system of claim 13, wherein the actuating mechanism comprises an electric actuating member configured to selectively move the furniture element between the utility position and the storage position.

15. The embedded furniture system of claim 13, wherein:

the actuating mechanism comprises a piston or strut connected to the furniture element and the stowage component;

the stowage component has (i) an inner surface that at least partially bounds the compartment, and (ii) an outer surface disposed opposite the compartment, and wherein the piston or strut is disposed at and connected to the outer surface.

16. A method of concealing embedded furniture, comprising:

providing a furniture assembly comprising:

a furniture stowage component having a recessed compartment; and a furniture element selectively stowable at least partially within the compartment; and covering at least a portion of the stowage component with a concealing element, the stowage component further comprising a body portion;

providing a wall element;

connecting the stowage component to the wall element such that the stowage component extends at least partially through the wall element;

wherein:

the wall element comprises a wall module comprising a frame element and a first wall panel connected to a first side of the frame element; and the body portion of the stowage component extends from a second side of the frame element, the second side being opposite the first side.

17. The method of claim 16, wherein:

covering at least a portion of the stowage component with a concealing element comprises inserting the body portion of the stowage component into a cavity of the concealing element; and the concealing element comprises a furniture-shaped covering having the cavity disposed therein.

18. The method of claim 16, wherein the furniture assembly further comprises:

an actuating mechanism connected between the furniture element and the stowage component, wherein the actuating mechanism:

(i) directs the furniture element between the utility position into the storage position; and (ii) provides a mechanical advantage for moving the furniture element from the utility position into the storage position, wherein the concealing element substantially conceals and covers the actuating mechanism.

19. The embedded furniture system of claim 18, wherein:

the actuating mechanism comprises an electric actuating member configured to selectively move the furniture element between the utility position and the storage position.

20. The embedded furniture system of claim 18, wherein:

the actuating mechanism comprises a piston or strut connected to the furniture element and the stowage component;

the furniture stowage component has: (i) an inner surface that defines the compartment, and (ii) an outer surface disposed opposite the compartment, and the piston or strut is disposed at and connected to the outer surface.

* * * * *